United States Patent [19]

Wilczynski

[11] 4,236,367

[45] Dec. 2, 1980

[54] BRICKLAYING APPARATUS

[76] Inventor: Mieczylaw Wilczynski, 47 Boronia Rd., Greenacre 2190, Australia

[21] Appl. No.: 936,346

[22] Filed: Aug. 24, 1978

[30] Foreign Application Priority Data

Aug. 26, 1977 [AU] Australia ..... PD1408

[51] Int. Cl.[3] ..... E04G 21/22

[52] U.S. Cl. ..... 52/749; 52/747

[58] Field of Search ..... 52/749, 747

[56] References Cited

U.S. PATENT DOCUMENTS

| | | | |
|---|---|---|---|
| 741,507 | 10/1903 | Knight | 52/749 |
| 772,191 | 10/1904 | Thomson | 52/749 |
| 1,054,635 | 2/1913 | Cagnassi | 52/749 |
| 2,648,974 | 8/1953 | Sommers | 52/749 |
| 3,325,960 | 6/1967 | James | 52/749 |

FOREIGN PATENT DOCUMENTS

| | | |
|---|---|---|
| 237380 | 7/1925 | United Kingdom . |
| 614711 | 12/1947 | United Kingdom . |
| 1353784 | 5/1974 | United Kingdom . |
| 1410657 | 10/1975 | United Kingdom . |

*Primary Examiner*—J. Karl Bell

*Attorney, Agent, or Firm*—Stevens, Davis, Miller & Mosher

[57] ABSTRACT

Apparatus for facilitating bricklaying is disclosed in which bricks positioned on a mortar bed on a previously laid course are aligned relatively to the previously laid course by means of parallel members provided with means contacting the side faces of the bricks, which members are progressively moved longitudinally of the course as it is laid. Mortar may be dispensed automatically onto the course being laid as the apparatus is moved along the course.

17 Claims, 14 Drawing Figures

20a
23
22
20
5
5
23
22
23

24a
26
24
26
25
7
7
26
25
26

36
42
43
22a
39
23
41

23
39
41
9
9
22a
23

BRICKLAYING APPARATUS

BACKGROUND OF THE INVENTION

This invention relates to apparatus for facilitating the laying of bricks. The apparatus according to the present invention functions accurately to align bricks previously positioned on a bed of mortar on a previously laid course, and to assist in the accurate laying of mortar between the courses.

SUMMARY OF THE INVENTION

The apparatus described herein is broadly characterised by first and second lateral alignment means disposed parallel to each other and extending longitudinally of the apparatus, each said alignment means comprising means adapted to engage the respective opposite side faces of the course at a plurality of points disposed in a straight line along a length of the course, the apparatus being adapted for progressive longitudinal movement along the course as it is laid.

Also described herein is a method of laying a course of bricks broadly comprising the steps of:

(a) positioning a row of bricks upon a mortar bed on a previously laid course, (b) positioning the apparatus described above on the row of bricks by movement of the apparatus longitudinally of the row laterally to align the bricks, (c) positioning further bricks in a further portion of the course, (d) moving the apparatus longitudinally to engage the further bricks, and (e) repeating the steps (a) to (d) above.

BRIEF DESCRIPTION OF THE DRAWINGS

To facilitate an understanding of the various aspects of the present invention, it will now be described in the several embodiments illustrated in the accompanying drawings. In these drawings.

DESCRIPTION OF THE PREFERRED EMBODIMENTS

Figure 1:
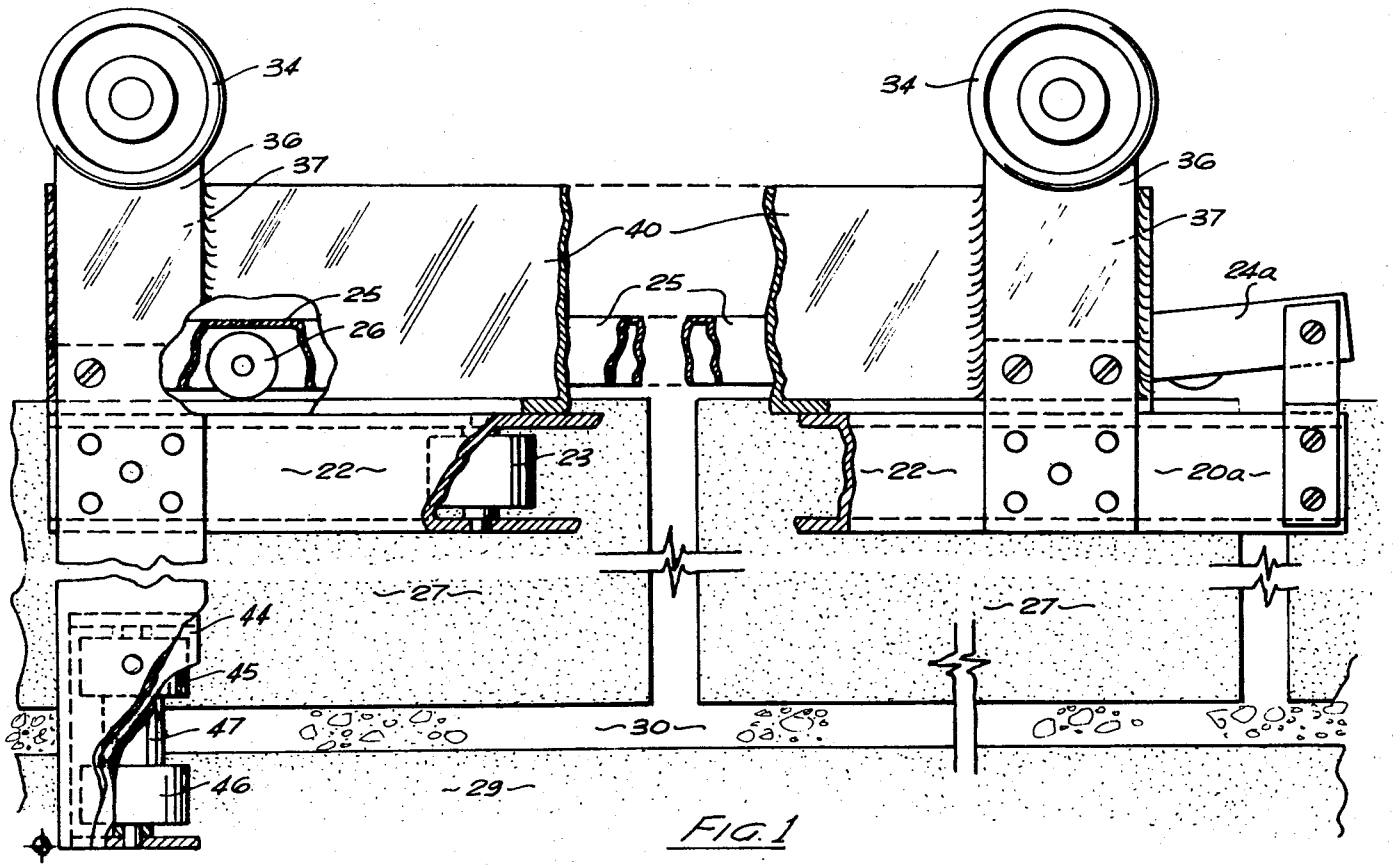
FIG. 1 is a partly sectioned fragmentary side elevation of the apparatus embodying the present invention, adapted to facilitate the laying of bricks in a double brick solid wall.
Figure 2:
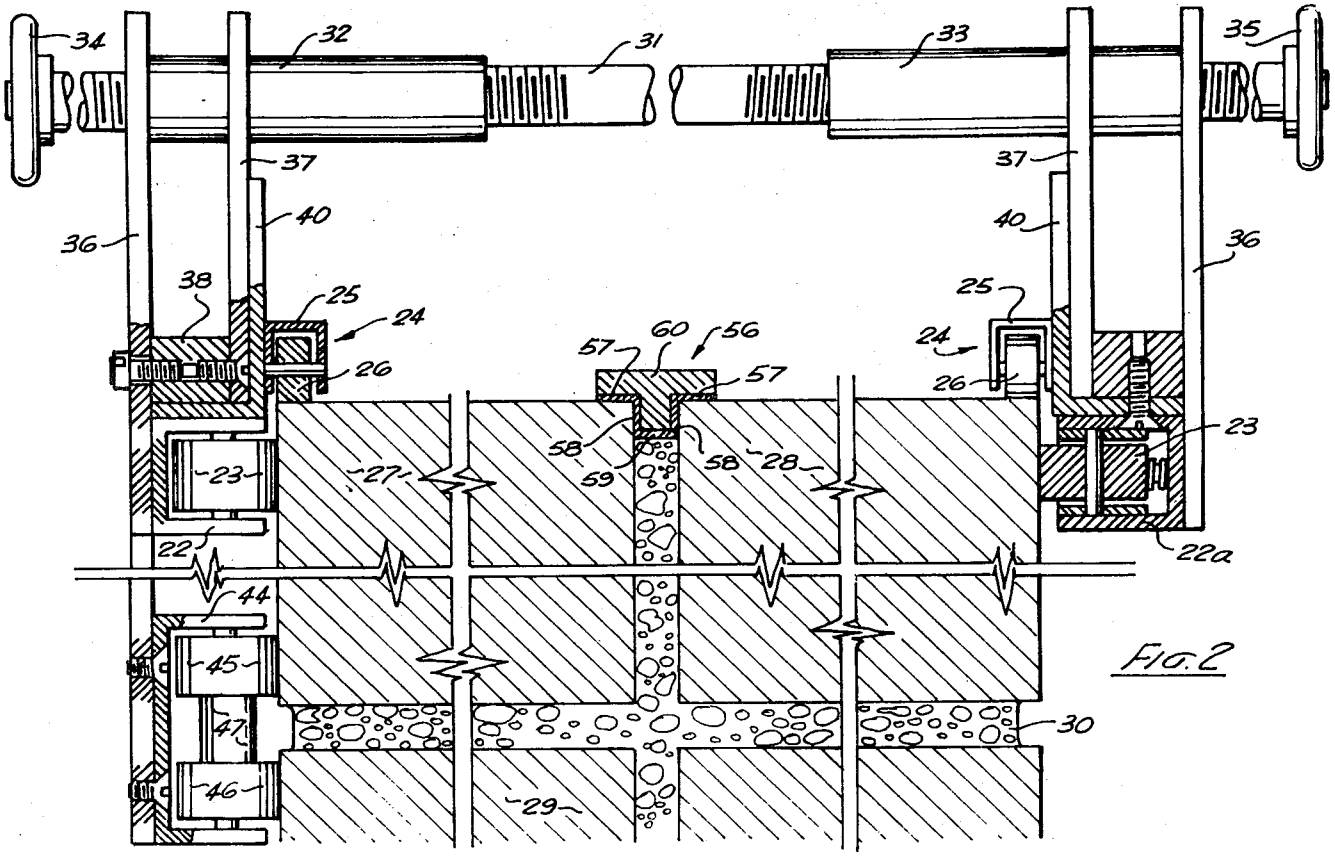
FIG. 2 is a partly sectioned end elevation of the apparatus of FIG. 1.
Figure 3:
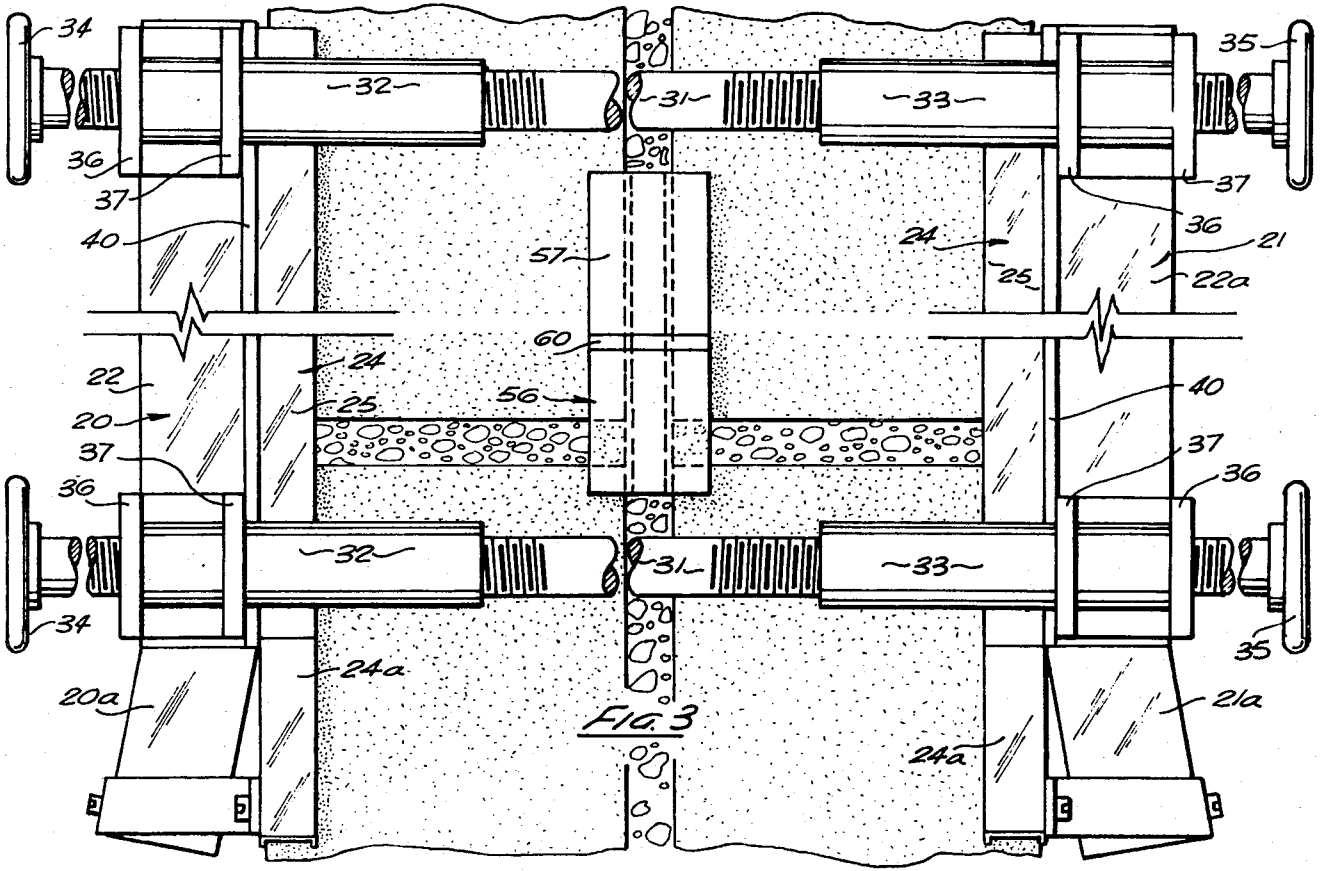
FIG. 3 is a fragmentary plan view of the apparatus.

Referring now to FIGS. 1 to 3, the apparatus there illustrated, for the laying of a 230 mm solid brick wall, comprises a pair of parallel longitudinally extending members 20 and 21, consisting respectively of a channel 22 and **22*a* extending longitudinally over the entire length of the apparatus, and each carrying at intervals along its length, rollers 23** of a suitable material such as nylon, these rollers being mounted within the channels for rotation about a vertical axis, and being adapted to ride against the side faces of the bricks of the course being laid.

The apparatus further comprises a pair of parallel longitudinally extending members 24, each consisting of a channel section member 25 extending longitudinally over the length of the apparatus, and carrying at intervals along its length rollers 26 mounted within the channel 25 with their axes horizontal. These rollers 26 are thereby adapted to ride from the upper face of the bricks of the course being laid and thereby to support the apparatus as a whole.

Shown at 27 and 28 in FIG. 2 are the adjacent bricks of a course engaged by the apparatus, a portion of the underlying course 29 also being shown with the intervening mortar layer 30.

The lateral spacing of the members is controlled by means of a pair of lateral shafts 31 located at opposite ends of the apparatus. These shafts 31 are provided at their end regions with oppositely-handed threads which engage correspondingly threaded collars 32 and 33. The shaft 31 may be rotated by means of handles 34 and 35 at each end of the shaft.

Attached to each collar 32, suitably by welding, is a vertical member 36. Also attached to each collar 32 is a member 37 which is fixed at its lower end to the member 36 by means of a fixing block 38 by means of a screw passing through the members 36 and 37. An L-shaped supporting member 40 is provided for supporting the channels 25, the vertical limb of which is fixed to the inner surface of the member 37, and the horizontal limb of which is fixed, together with the upper horizontal limb of the upper channel 32, to the fixing block 38, by means of a screw (not shown). The channel 25 on the left hand side of the apparatus as shown in FIG. 2 is fixed to the inner face of the supporting member 40 by suitable means such as welding or riveting.

On the right hand side of the apparatus as seen in FIG. 2, a similar support structure is provided in this case consisting of members again designated 36 and 37 attached to the collars 33, and support blocks 38.

Figures 4, 5, 6, 7, 8, 9:
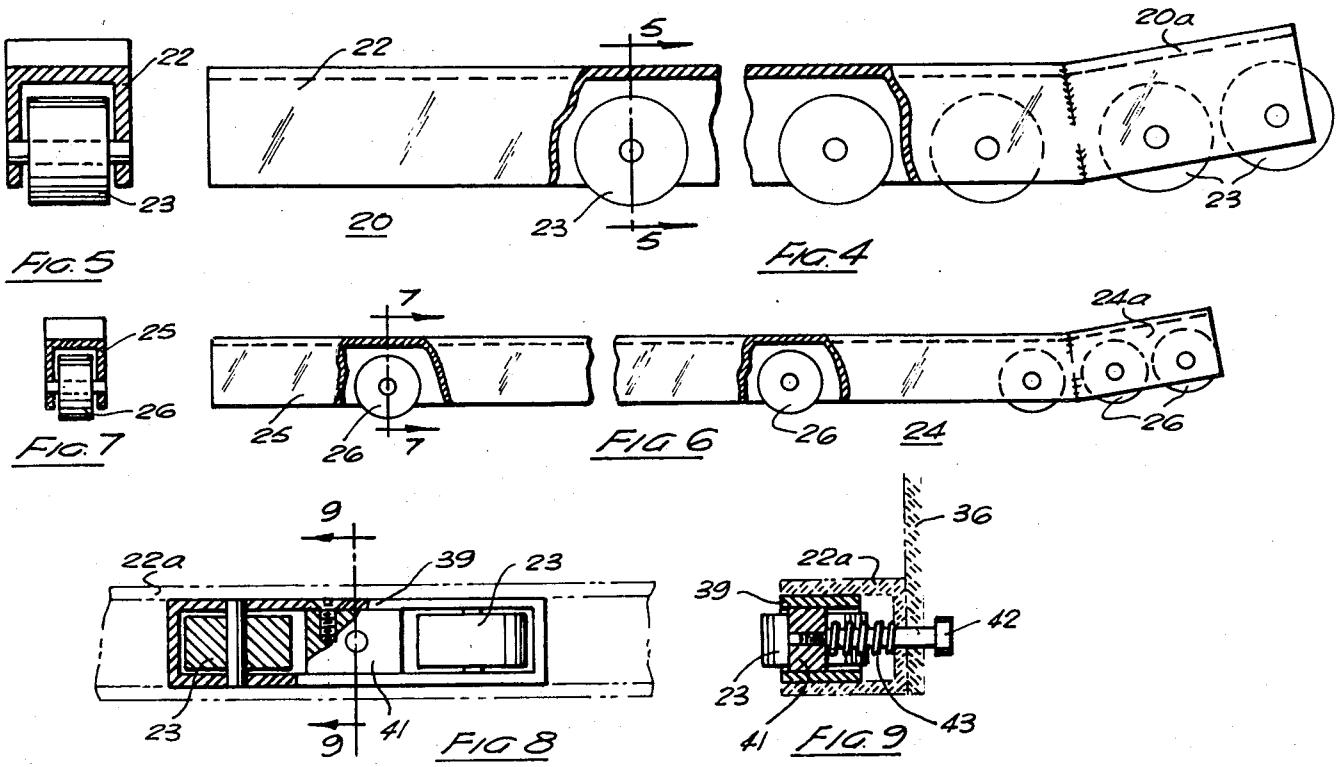
FIG. 4 shows a partly sectioned fragmentary plan view of a detail of the apparatus illustrated in the preceding figures.
FIG. 5 is a cross-section taken on the line 5—5 of FIG. 4.
FIG. 6 is a fragmentary plan view of portion of the apparatus of the FIGS. 1 to 3.
FIG. 7 is a cross-section taken on the line 7—7 of FIG. 6.
FIG. 8 is a partly sectioned elevation of a spring mounting means for the rollers one of the members of the apparatus.
FIG. 9 is a cross-sectional elevation taken on the line 9—9 of FIG. 8.

The detailed construction of the member 20 is shown in FIGS. 4 and 5. The channel sectioned member 22 which is preferably of steel, is, as noted above, provided at intervals along its length with rollers 23. The location of these rollers is chosen so that at any instant, two such rollers of each member 20 are in contact with the same brick.

At the forward end of the apparatus, that is to say the end of the apparatus which first meets new work as the apparatus is moved along with the course being laid, the member 20 is provided with an end portion **20*a* disposed obliquely to the longitudinal axis of the member 20, and away from the general plane of the brick side faces. The purpose of this oblique end portion 20***a* is to enable the apparatus to engage and bring into alignment the bricks being laid, as it is moved longitudinally of the course of bricks laid approximately in their correct position. It will be seen that the end portion 20*a* carries two rollers 23.

At the forward end of the member 21 a simlar oblique end portion is provided, again carrying two rollers 23.

As shown in FIGS. 6 and 7, the construction of the members 24, is basically similar to that of the member 20. Again an obliquely disposed end portion 24*a* is provided for the same purpose as the portion 20*a* of the members 20 and 21.

The rollers 23 of the member 20 are mounted on axles to the side members of the channel 22, as are the rollers 26 of each member 24 fixed similarly their channels 25. The rollers 23 of the member 21, however, are mounted for self-adjustment in the horizontal direction, to take into account variations in the width of the bricks being laid. This mounting arrangement is detailed in FIGS. 8 and 9, from which it will be seen that pairs of rollers 23 are mounted within a cage 39 of rectangular configuration, the roller axles being fixed between the upper and lower members forming the cage. At the center of the cage 39 there is located a block 41, by which the cage is supported in the channel 22*a*. This block is in turn supported by a bolt 42 which is passed through aligned apertures in the support member 36 and the vertical web of the channel 22*a*, a compression spring 43 surrounding the bolt 42 in the space between the block 41 and the opposed face of the vertical web of the channel 22*a*. In this way the rollers 23 of the member 22*a*, with the exception of those rollers mounted on the end of the oblique end portion 21*a*, are urged against the side faces of the adjacent brick, but may move resiliently to take into account variations in the width of bricks.

To assist in the alignment of bricks in the course being laid, with reference to the underlying course of bricks, it will be seen that the members 36 at the rear end of the apparatus are extended downwardly to carry by means of brackets 44, upper and lower rollers respectively designated as 45 and 46. These rollers are mounted on axles supported by the brackets 44, and are separated by spacers 47 such that the upper rollers 45 may bear against the lower side face of the bricks 27 on the outside face of the course being laid, while the lower rollers 46 bear against the upper side face of the corresponding bricks of the previously laid course 29.

Figure 12:
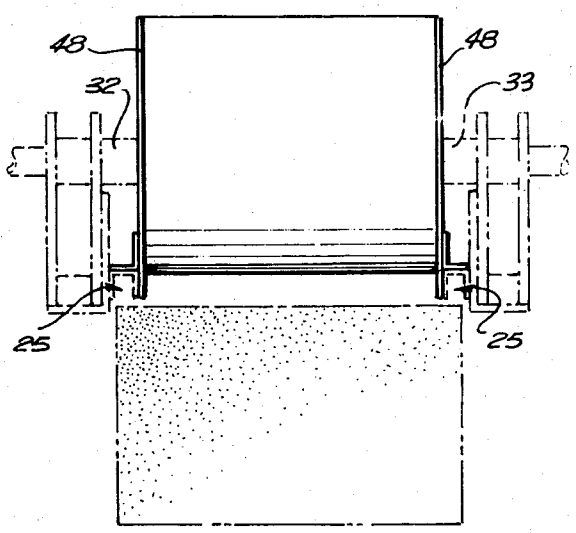
FIG. 12 is an end elevation of the mortar dispenser of FIG. 10, showing it in position on the apparatus.
Figure 10:
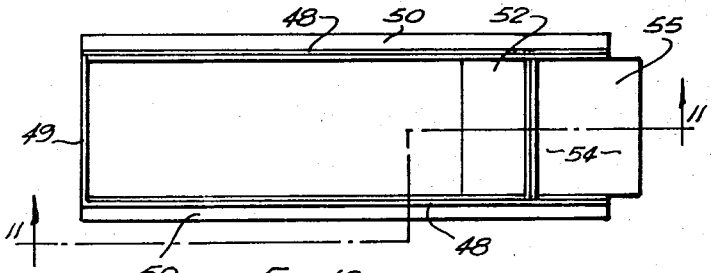
FIG. 10 is a plan view of a mortar dispenser for use in conjunction with the apparatus of FIGS. 1 to 9.
Figure 11:
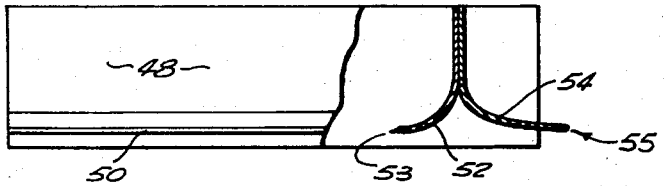
FIG. 11 is a partly cross-sectioned elevation taken on the line 11—11 of FIG. 10.

In conjunction with the apparatus so far described, it is preferred to employ a mortar dispenser as illustrated in FIGS. 10 to 12, to enable automatically the dispensing of mortar onto the upper surface of the bricks of the course being laid, as the apparatus is moved forwardly in aligning the course. This mortar dispenser is formed of sheet metal and is basically of rectangular box-like construction, comprising a pair of side walls 48, and a front wall 49. The dispenser is open at the top and the bottom, and is provided with a pair of horizontal flanges 50 attached to the side walls 48. The purpose of these flanges 50 is to support the dispenser on the upper surfaces of the webs of the channel members 25, with the lower portion of the dispenser sitting neatly between inner faces of the flanges of the channel members 25.

The rear ends of the side walls 48 of the mortar dispenser rest against the collars 32 and 33 forcing the dispenser to move together with the apparatus while resting on the channels 25, at the rear end of the apparatus.

At the forward end of the mortar dispenser, there is provided a first downwardly and rearwardly curved mortar control wall 52 which is provided at its rearwardly facing lower edge 53 with a knife edge, and a second mortar control member 54 which is curved downwardly and forwardly to terminate in a horizontal end portion 55. The knife edge 53 and the end portion 55 are placed precisely at the required height above the underlying bricks, to define the correct thickness of mortar between courses.

The mortar dispenser is filled with mortar after being placed on the apparatus, and as the apparatus is moved forward aligning bricks placed on the mortar bed overlying the previous course, mortar contained within the dispenser will be applied to the bricks of the course being laid, the knife edge 53 serving as it passes to cut the mortar at the required height and the curved formation of the wall 52 serving to return mortar cut above the required height to the body of mortar being continuously dispensed onto the bricks, while the curved surface 54 and the end portion 55 serve to apply smoothing pressure to the mortar dispensed, and also to apply pressure to the underlying bricks. It has been found that this pressure obviates the need for any tapping or hammering of the newly laid bricks onto the underlying mortar bed, and provides at least as strong a wall construction as would be achieved by that technique.

It will be seen in FIG. 12 that the bottom of the side walls 48 of the mortar dispenser fit neatly between the channels 25 to define the lateral extent of the mortar bed, automatically providing a raked joint. If flush joints are required, the mortar dispenser may be appropriately modified for mounting rearwardly of the ends of the channels 25.

As mentioned above, and is apparent from the drawings, the apparatus thus far described is applicable to the case of a solid double brick wall, where of course a gap is provided between the adjacent bricks of each course, which gap may, if desired or if required by building regulations, be mortar-filled. To assist in the setting of this spacing, a manual guide member 56 may be provided, as shown in position in FIGS. 2 and 3, which consists of a pair of horizonal flanges 57 adapted to rest on the upper surface of the adjacent bricks, downwardly depending on flanges 58 adapted to engage the oppose inner faces of the bricks, and joined by a web 59. A vertical and laterally disposed gripping flange 60 completes this spacing device.

As will largely be apparent from the foregoing description, the method of use of the embodiments illustrated in FIGS. 1 to 13 is as follows.

The previously laid course will have an overlying mortar layer applied during the aligning of the course as described above. Mortar is applied to the end faces of bricks assembled for application to the next course, and these are laid on the mortar bed, neatly but without great care in their alignment, for a length of the course somewhat greater than the length of the apparatus. A suitable length of apparatus is in the region of 1,200 mm.

The forward end of the apparatus is then engaged with the new course of bricks, and the apparatus moved forward until it is wholly in engagement with the course, when the lower rear rollers 45 and 46 will engage the bricks of the course being laid and the underlying course. At this point the mortar dispenser of FIGS.

10 to 13 is mounted on the apparatus at the rear end thereof, and filled with mortar.

Furter bricks are laid ahead of the apparatus, and again the apparatus moves forwardly, this time not only aligning the new bricks, but also applying mortar to the length of bricks first applied.

This procedure is repeated until the end of the course is reached, the motar dispenser being refilled as required.

It is preferred that level indicating devices are provided on the apparatus, although these are not illustrated herein as they may be of any conventional and well-known type. For example, a spirit level may be provided for each of the longitudinal and lateral directions of the apparatus, or other level indicating devices may be used, such as a tube carrying conductive liquid (for example water) provided at each end with electrical contacts associated with a warning device such as a bell or buzzer.

By the use of such level indicating means, minor adjustments to level can be made during the laying of a course, although the use of this apparatus throughout the building of the wall, having started with a perfectly level first course, minimizes the likelihood of errors in level.

Where it is desired to use the apparatus illustrated in FIGS. 1 to 13 in the laying of a single brick wall, for example in brick veneer construction, the only modifications necessary to the apparatus illustrated are the substitution of shorter shafts 31, thereby bringing the respective sides of the apparatus closer together, and the use of a mortar dispenser of correspondingly reduced width. The method of laying the bricks in this case is the same as that described above, although of course the spacing guide 56 is not used.

Figure 13:
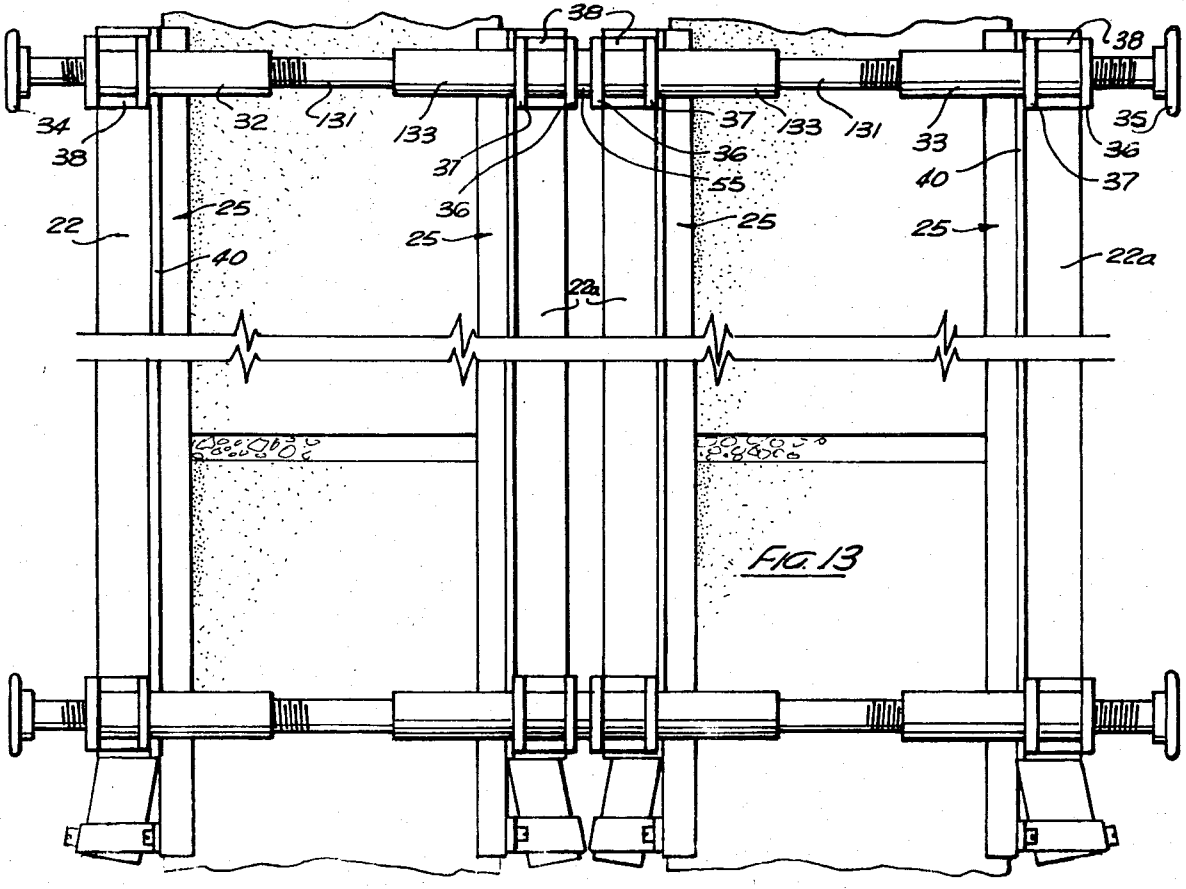
FIG. 13 is a fragmentary plan view of a modified form of the apparatus adapted for use in the laying of a cavity wall.
Figure 14:
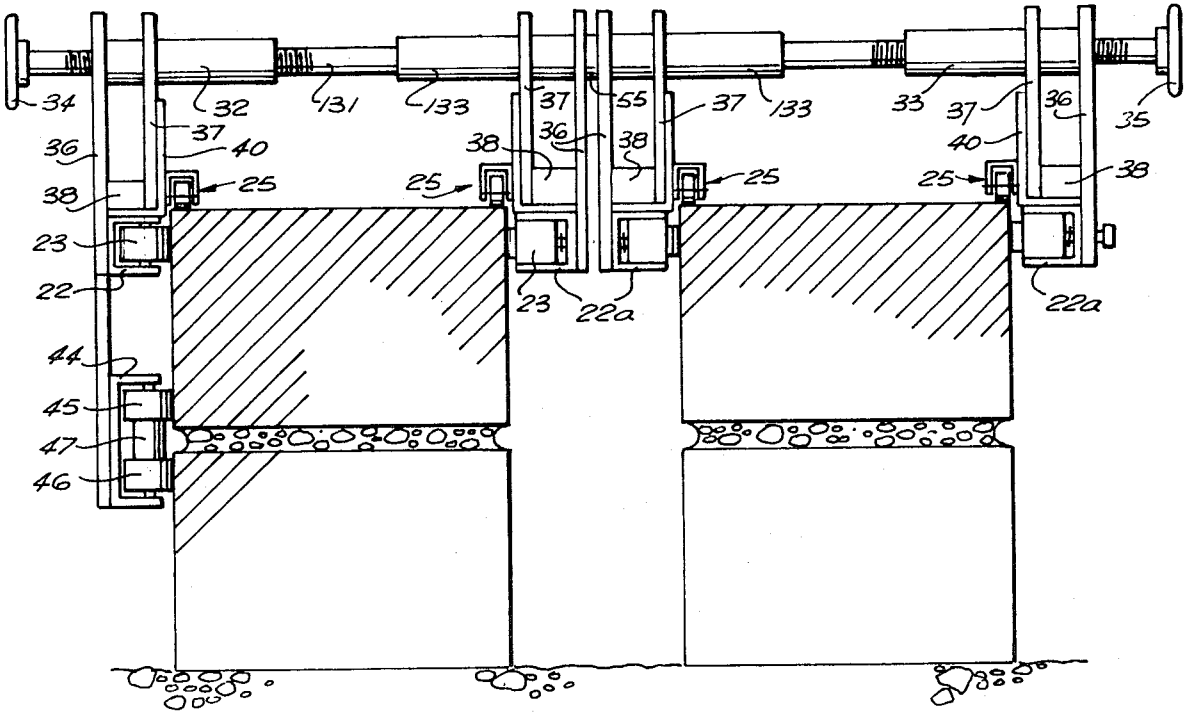
FIG. 14 is a cross-sectional elevation taken on the lines 15—15 of FIG. 14.

In the laying of a full brick cavity wall, the apparatus is duplicated as shown in FIGS. 13 and 14 where it will be seen that the duplicated part of the apparatus as shown on the right hand side of FIG. 14, which is essentially a mirror image of the left hand portion of the apparatus, is provided with the same arrangement of longitudinal guide members provided with rollers. The parts of the duplicated apparatus are given corresponding reference numerals to those of the corresponding parts of FIGS. 1 to 9.

In this case, the shafts 31 are replaced by a long shaft 131 extending right across the width of the apparatus, and the collars 133, and the portion of the shaft 131 passing through them, are unthreaded. The correct spacing between the opposed vertical support members 36 is set by a collar 55 mounted on the shaft 131 at its center.

It will be appreciated that many departures from and modifications to the apparatus described in relation to the illustrated embodiments, may be made without departing from the scope of the invention and, these will be apparent to those skilled in the art. For example, the mortar application technique may be varied, and mortar may be applied in a separate operation, the mortar between the opposed brick end faces being applied, for example, after the laying and alignment of the bricks by the apparatus of the invention.

To facilitate the laying of wall junctions and corners, the ends of the apparatus may be mitred so that two similar units may be brought together at the wall junction or corner.

I claim:

1. An apparatus for facilitating the laying of a course of bricks comprising:

first and second lateral alignment means disposed parallel to each other and extending longitudinally of the apparatus, each said alignment means comprising:

a plurality of rollers for engaging a respective opposite side face of the course at a plurality of points disposed in a straight line along a length of a course, and means located at a forward end portion of a respective alignment means adapted to engage a respective opposite side face of the course at at least one point disposed outwardly of said course in relation to a straight line; and support means adapted to engage the upper surface of said course.

2. Apparatus as defined in claim 1, wherein the rollers of one of said first or second lateral alignment means are mounted resiliently for lateral movement relative to said course, said rollers being urged toward the course.

3. Apparatus as defined in claim 1, wherein the engagement means of each said end portion comprise rollers.

4. Apparatus as defined in claim 1, wherein said support means comprises a plurality of rollers adapted to engage the upper surface of the course adjacent the sides thereof.

5. Apparatus as defined in claim 1, wherein said support means further comprises a forward end portion carrying at least one roller disposed outwardly of the course in relation to the line of said plurality of said rollers.

6. Apparatus as defined in claim 1, further comprising means for adjusting the lateral spacing of said lateral alignment means.

7. Apparatus as defined in claim 6, wherein said adjustment means comprises a shaft extending laterally of the apparatus, said shaft being provided adjacent its ends with oppositely-handed screw threads, said screw threads engaging collars operatively attached to the respective alignment means.

8. Apparatus as defined in claim 7 wherein one such shaft is provided adjacent each end of the apparatus.

9. Apparatus as defined in claim 1 further comprising third lateral alignment means adapted to engage a side face of the course of bricks underlying the course being laid.

10. Apparatus as defined in claim 9 wherein said third alignment means comprises at least one roller adapted to contact a side face of the underlying course of bricks, said roller being mounted rigidly in relation to said first lateral alignment means.

11. Apparatus as defined in claim 1 further comprising a mortar dispenser adapted to be removably positioned on said apparatus for movement therewith along the course as it is laid thereby to dispense mortar onto the upper surface of said course.

12. Apparatus as defined in claim 11 wherein said mortar dispenser comprises a container open at its bottom for dispensing mortar onto said course, and comprising means defining the thickness of mortar dispensed.

13. Apparatus as defined in claim 12 wherein said means defining mortar thickness comprises a first cutting edge extending across the mortar dispenser, and a trowelling surface extending rearwardly of said cutting edge.

14. Apparatus for facilitating the laying of a double course of bricks with a cavity therebetween, comprising first and second lateral alignment means disposed parallel to each other and extending longitudinally of the apparatus, said first and second alignment means comprising means adapted to engage the respective opposite side faces one of the courses at a plurality of points disposed in a straight line along a length of that course, third and fourth lateral alignment means disposed parallel to each other and extending longitudinally of the apparatus, said third and fourth alignment means comprising means adapted to engage the respective opposite side faces of the other course at a plurality of points disposed in a straight line along the length of that course, the apparatus being adapted for progressive longitudinal movement along the course as it is laid.

15. Apparatus as defined in claim 14 further comprising support means adapted to engage the upper surface of each course.

16. Apparatus as defined in claim 14 wherein each of said means adapted to engage the side faces of a course comprise a plurality of rollers.

17. Apparatus as defined in claim 16, wherein rollers of one of said first or second alignment means, and the rollers of one of said third or said fourth alignment means, are mounted resiliently for lateral movement relative to the respective course, said rollers being urged toward said course.

* * * * *